US006905087B2

(12) United States Patent
Chen

(10) Patent No.: US 6,905,087 B2
(45) Date of Patent: Jun. 14, 2005

(54) HOSE REEL DEVICE

(76) Inventor: He Jin Chen, No. 11, Lane 188, Gungye Road, Lung Shiang, Taichung (TW)

( * ) Notice: Subject to any disclaimer, the term of this patent is extended or adjusted under 35 U.S.C. 154(b) by 81 days.

(21) Appl. No.: 10/642,243

(22) Filed: Aug. 18, 2003

(65) Prior Publication Data

US 2005/0040274 A1 Feb. 24, 2005

(51) Int. Cl.[7] ..... B65H 75/48
(52) U.S. Cl. ..... 242/375.3
(58) Field of Search ..... 242/375.3

(56) References Cited

U.S. PATENT DOCUMENTS 2,133,551 A * 10/1938 Logan ..... 242/375.3
2,587,308 A * 2/1952 Gilette ..... 242/375.3
2,996,584 A * 8/1961 Roark ..... 242/375.3
4,036,449 A * 7/1977 Schreiber ..... 242/375.3
4,301,977 A * 11/1981 Yang ..... 242/375.3
5,173,067 A * 12/1992 Biba ..... 242/375.3
5,820,057 A * 10/1998 Decarolis et al. ..... 242/375.3
5,920,997 A * 7/1999 Girtman ..... 242/375.3

* cited by examiner

*Primary Examiner*—William A. Rivera
(74) *Attorney, Agent, or Firm*—Rosenberg, Klein & Lee

(57) ABSTRACT

A hose reel device includes a casing having a box received therein and a mandrel located in the box so that a hose is wrapped on the mandrel. A side plate is connected to an end of the box and a coil spring is disposed to the side plate. A transmission gear set located between the box and the side plate. The transmission gear set includes a first gear co-axially connected to an axle of the mandrel, and a second gear is co-axially connected to the coil spring and engaged with the first gear. A resistance gear set is engaged with the first gear and includes a clutch member which disengages the rotational movement of the first gear from the resistance gear set when pulling the hose out from the casing and connects the rotational movement of the first gear to the resistance gear set when retrieving the hose.

6 Claims, 11 Drawing Sheets

HOSE REEL DEVICE

FIELD OF THE INVENTION

The present invention relates to a hose reel device that includes a resistance device for reduce the force and speed of the hose with a heavy end when retrieving the hose.

BACKGROUND OF THE INVENTION

A conventional hose reel device 10 is shown in FIGS. 1 and 2 and generally includes a mandrel 12 located in a casing 11 and a rotatable member 14 is mounted to the mandrel 12. A coil spring 13 is fixed to the mandrel 12 and one end of the coil spring 13 is fixed to the mandrel 12 and the other end of the coil spring 13 is fixed to a notch 141 defined in a periphery of the rotatable member 14, so that when the coil spring 13 is released, the rotatable member 14 is rotated to retrieve the hose "a" which is wrapped around the rotatable member 14. A sprinkle or a nozzle "a'" is connected to a distal end of the hose "a" and is extended out from the opening 16 of the hose reel device 10 and a roller assembly 15 located in the opening 16. A plurality of positioning members 17 which includes slots 171 and stops 172. A pawl 18 is connected to a spring 181 so as to be engaged with the slots 171, such that the rotatable member 14 can only be rotated in one direction. A lever 19 is pivotably connected to the casing 11 and can be operated to engage with the stop 172 such that the rotatable member 14 cannot be rotated and the hose "a" is fixed at a desired length. When retrieving the hose "a", as shown in FIG. 2, the lever 19 is disengaged from the stop 172 and the pawl 18 is disengaged from the slots 171. The coil spring 13 is then released freely to retrieve the hose "a". Nevertheless, because the coil spring 13 is released freely, so that the metal or heavy sprinkle or nozzle "a' "connected to the remote end of the hose "a" moves at a high speed and could damage objects that are hit by the sprinkle or nozzle "a'".

The present invention intends to provide a hose reel device which includes a resistance device that reduces the retrieving speed of the hose so as to improve the shortcoming of the conventional hose reel device.

SUMMARY OF THE INVENTION

In accordance with one aspect of the present invention, there is provided a hose reel device which comprises a casing having a box received therein and a mandrel located in the box for a hose being wrapped on the mandrel. A side plate is connected to an end of the box and has a shaft extending from an inside of the side plate so that a coil spring is mounted to the shaft. A transmission gear set is located between the box and the side plate and includes a first gear co-axially connected to an axle of the mandrel. A second gear is co-axially connected to the coil spring and engaged with the first gear. A resistance gear set is engaged with the first gear and includes a clutch member which disengages the rotational movement of the first gear from the resistance gear set when pulling the hose, and connects the rotational movement of the first gear to the resistance gear set when retrieving the hose.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
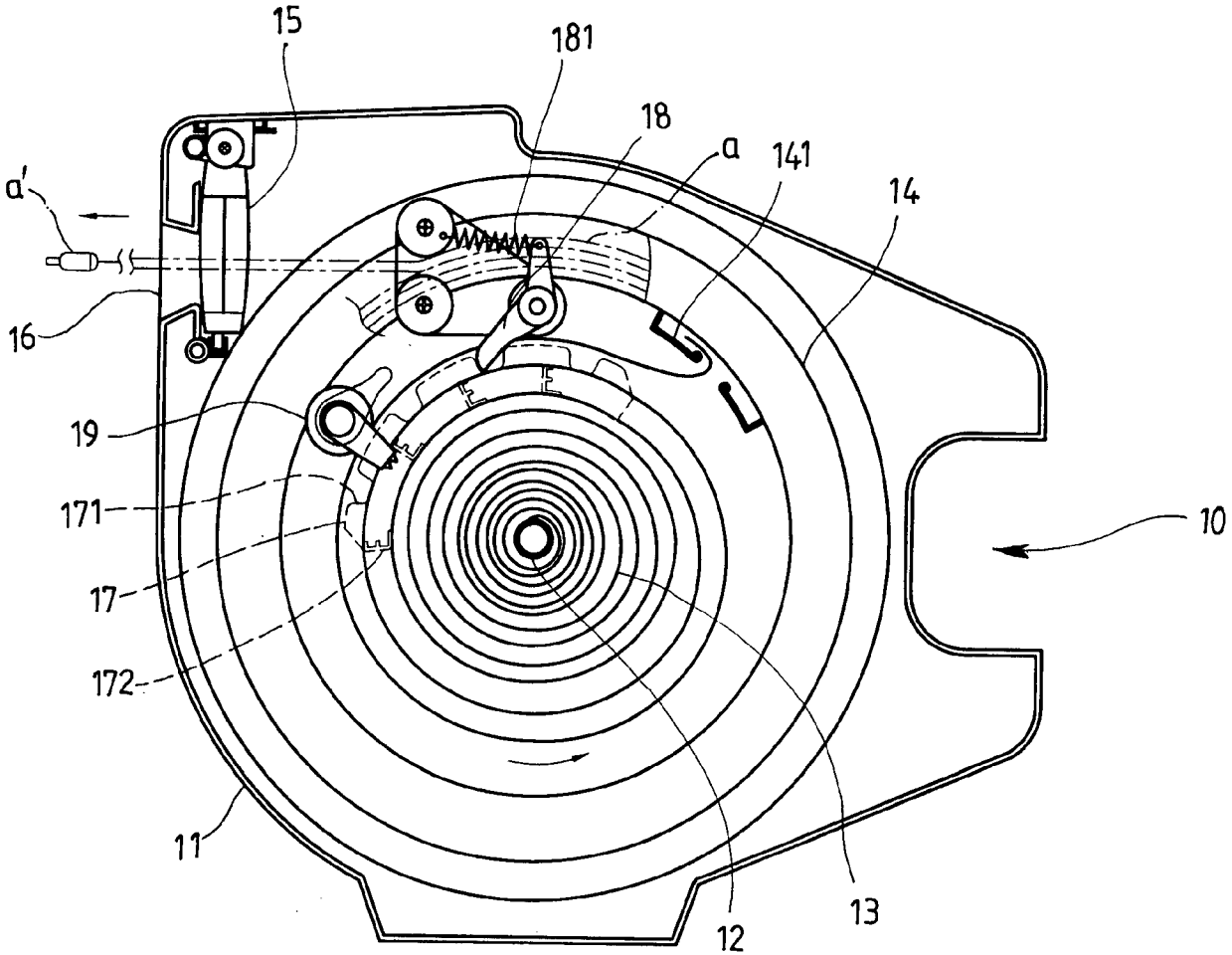
FIG. 1 PRIOR ART
FIG. 1 is side view to show a conventional hose reel device when the rotation member is fixed.
Figure 2:
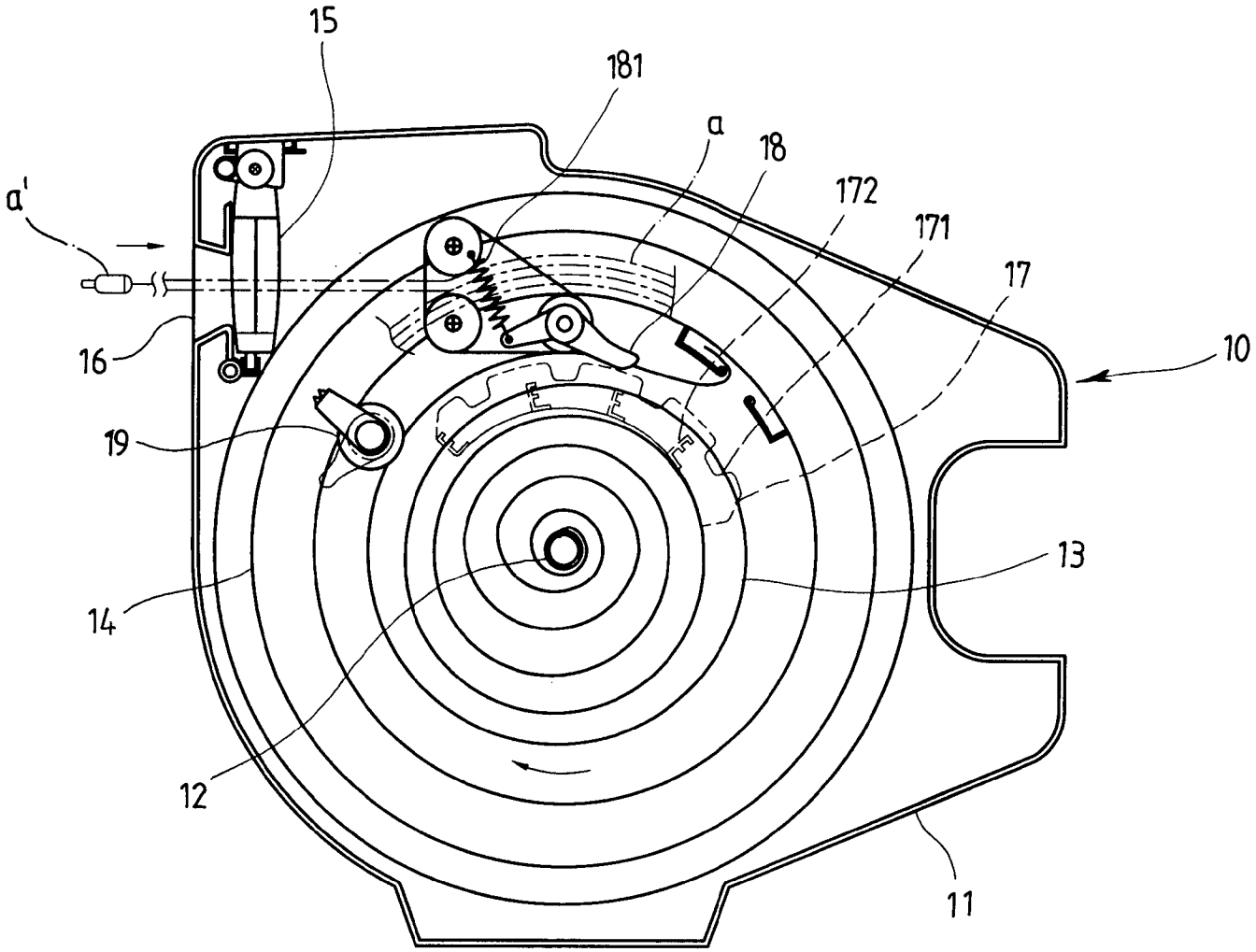
FIG. 2 PRIOR ART
FIG. 2 is a side view to show the conventional hose reel device when the rotation member is rotated to retrieve the hose.
Figure 3:
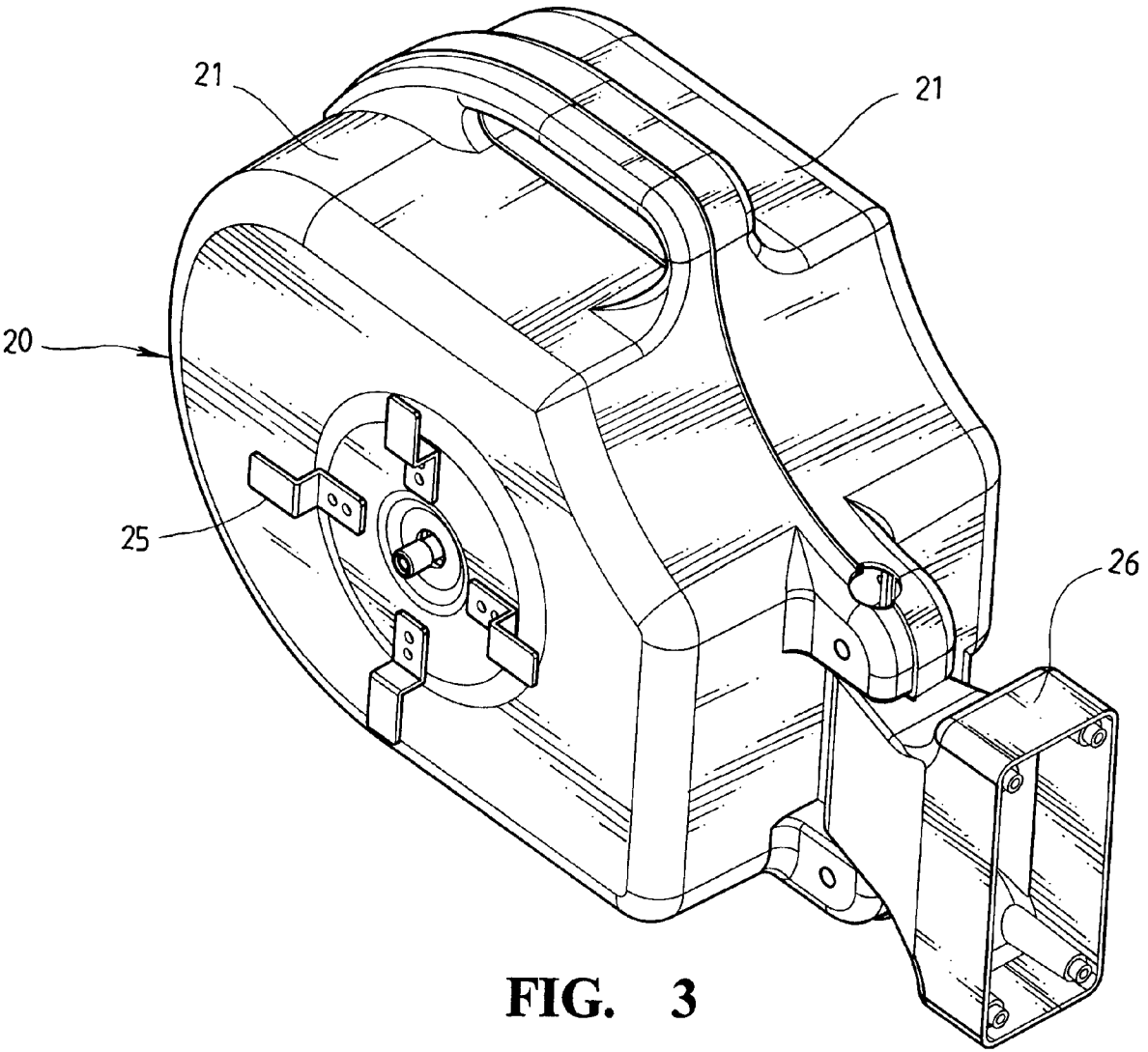
FIG. 3 is a perspective view to show the hose reel device of the present invention.
Figure 4:
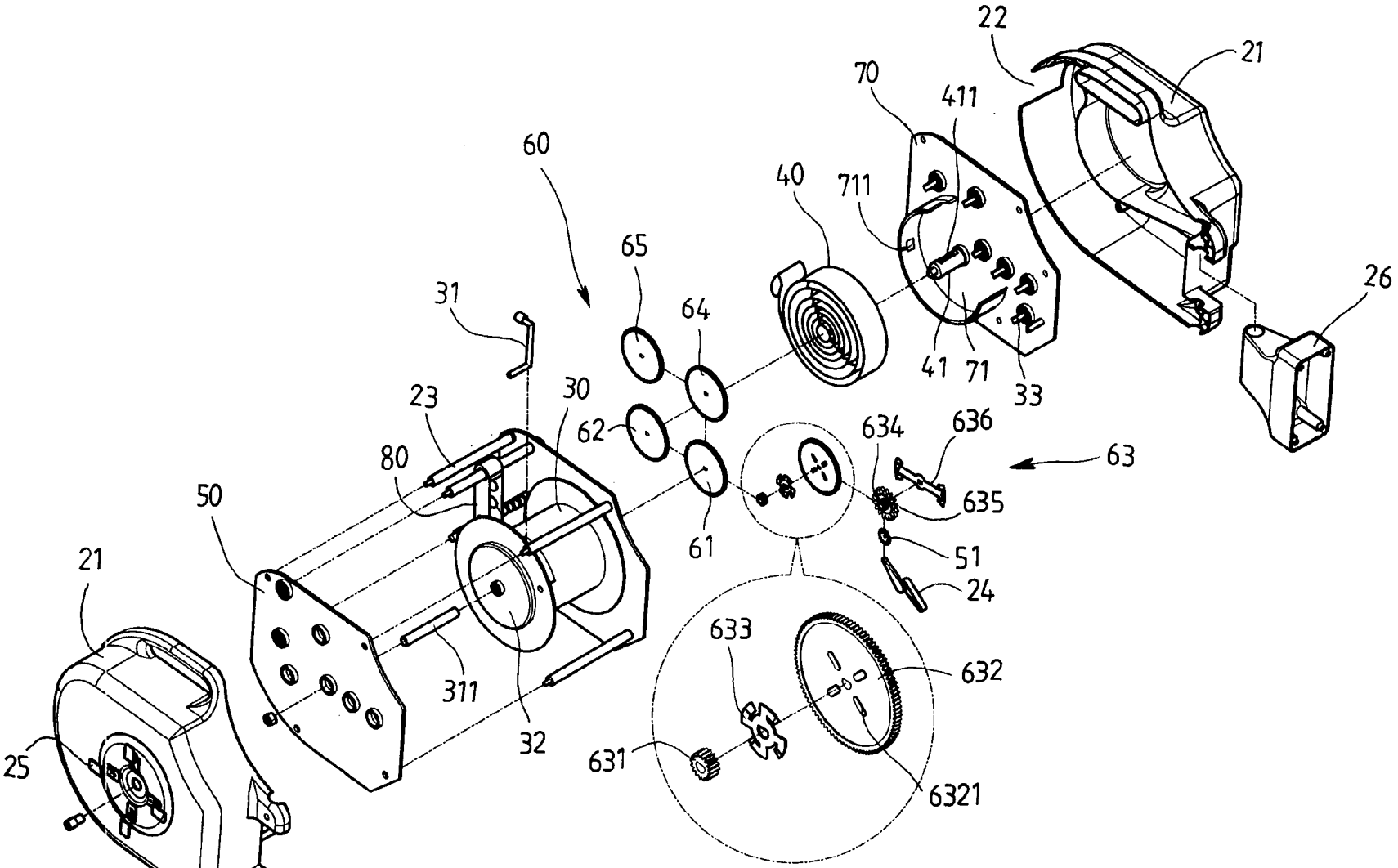
FIG. 4 is an exploded view to show the hose reel device of the present invention.
Figure 7:
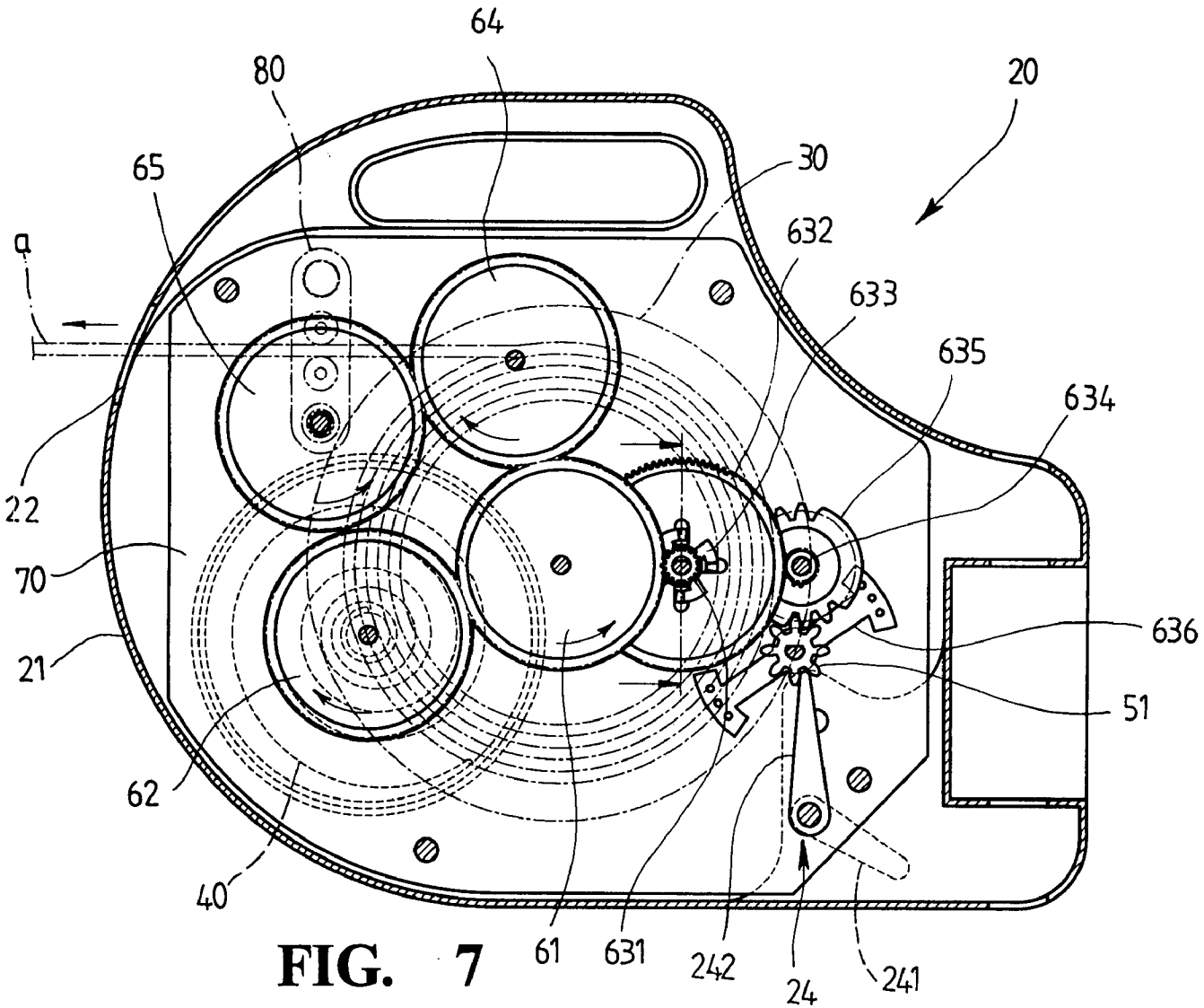
FIG. 7 shows that the locking gear is locked by the pawl of the hose reel device of the present invention.

Referring to FIGS. 3, 4 and 7, the hose reel device of the present invention comprises a casing 20 which is composed of two halves 21 and has an opening 22 defined therethrough. A fixing port 26 is connected to the casing 20 so as to fix the casing 20 on a wall. A box 50 is received in the casing 20 and composed of two boards with connection rods 23 connected therebetween. A mandrel 30 is rotatably disposed in the box 50 by an axle 32 and has a connection member 31 so that a hose "a" is connected to the connection member 31 and wrapped on the mandrel 30. A guidance piece 80 is movably connected to the connection rods 23 so as to guide the hose "a".

A side plate 70 is connected to an end of the box 50 and has a shaft 41 extending from an inside of the side plate 70. A coil spring 40 is mounted to the shaft 41 and has a first end fixed to a slit 411 defined in the shaft 41. A wall extends from the side plate 70 and encloses a space 71 for receiving the coil spring 40. A notch 711 defined in the wall and a second end of the coil spring 40 is engaged with the notch 711.

A transmission gear set 60 is located between the box 50 and the side plate 70 by mounting gears thereof to the gear shafts 33 on the side plate 70. The transmission gear set 60 includes a first gear 61 which co-axially connected to an axle 32 of the mandrel 30. A second gear 62 is co-axially connected to the coil spring 40 and engaged with the first gear 61. A transmission gear 64 is engaged with the first gear 61 and a driving gear 65 respectively. The driving gear 65 drives the guidance piece 80 which evenly wraps the hose onto the mandrel 30.

A resistance gear set 63 is engaged with the first gear 61 and includes a third gear 631 which is engaged with the first gear 61 and has only one-fifth of the number of teeth of the first gear 61. A fourth gear 632 is co-axially connected to the third gear 631. A fifth gear 634 is engaged with the fourth gear 632 and has only one-fifth of the number of teeth of the fourth gear 632. A sixth gear 635 is co-axially connected to the fifth gear 634. A locking gear 51 is engaged with the sixth gear 635 and a flywheel 636 is co-axially connected to the locking gear 51.

Figure 6:
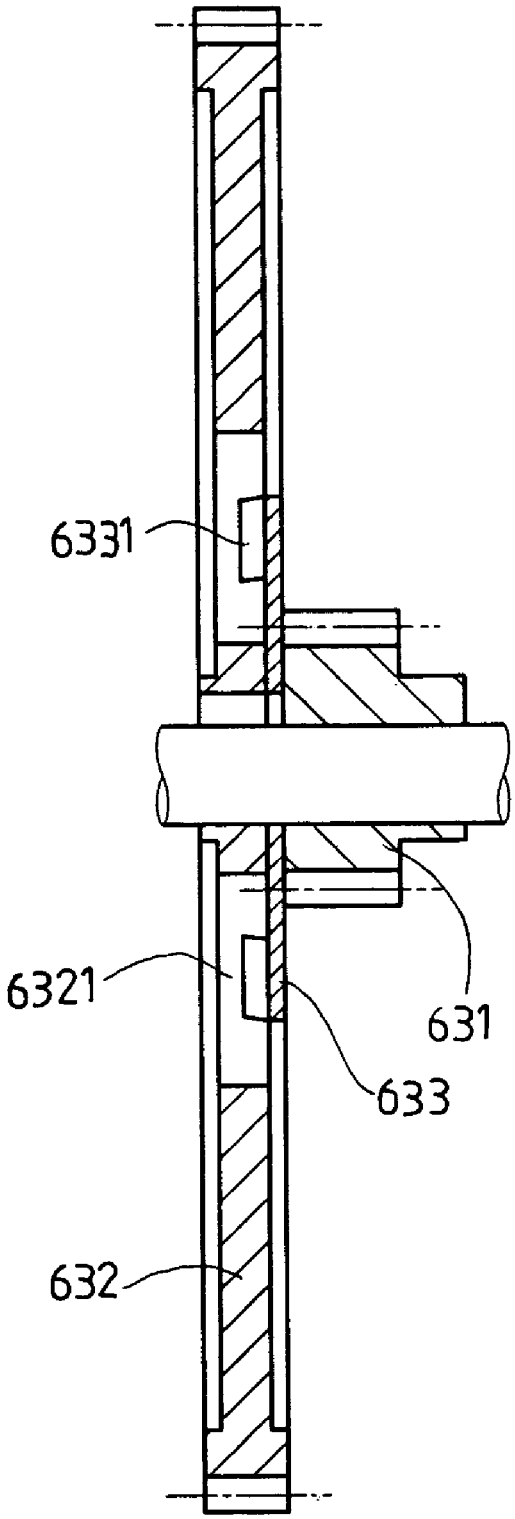
FIG. 6 is a cross sectional view to show the tongues of the clutch member are expanded to engage with the fourth gear.

The fourth gear 632 includes a plurality of holes 6321 defined therethrough and a clutch member 633 is located between the third gear 631 and the fourth gear 632. The clutch member 633 has a plurality of tongues 6331 (FIG. 6) which are pivotably connected to the clutch member 633. The tongues 6331 can be expanded to engage with the holes 6321 in the fourth gear 632 when the hose is retrieved.

Figure 5:
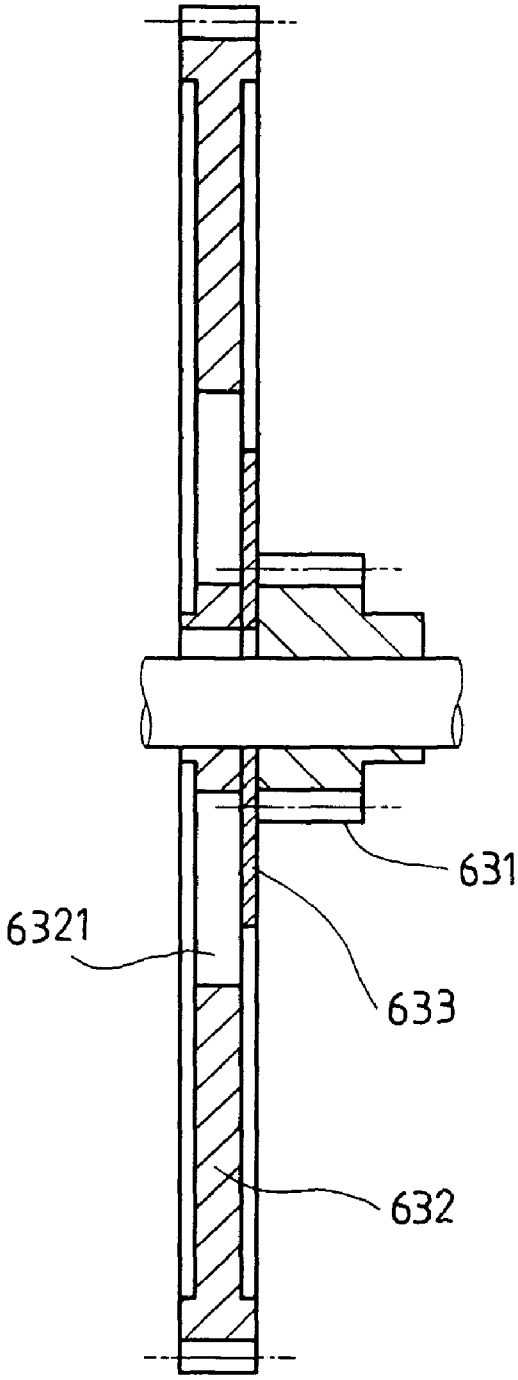
FIG. 5 is a cross sectional view to show the clutch member is not yet activated to engage with the fourth gear.

A control member 24 is pivotably connected to the casing 20 and includes a lever 241 and a pawl 242 which disengagably locks locking gear 51 by operating the lever 241. As shown in FIGS. 5 and 7, when the pawl 242 is engaged with the locking gear 51, and the hose "a" is pulled out from the casing 20, the rotational direction of the clutch member 633 cannot expand the tongues 6331 to engage with the holes 6321 in the fourth gear 632, so that there is less resistance for the user to pull the hose "a". Even if the hose "a" is released during pulling, because the locking gear 51 is not allowed to rotate by the pawl 242, the hose "a" cannot be retrieved.

Figure 8:
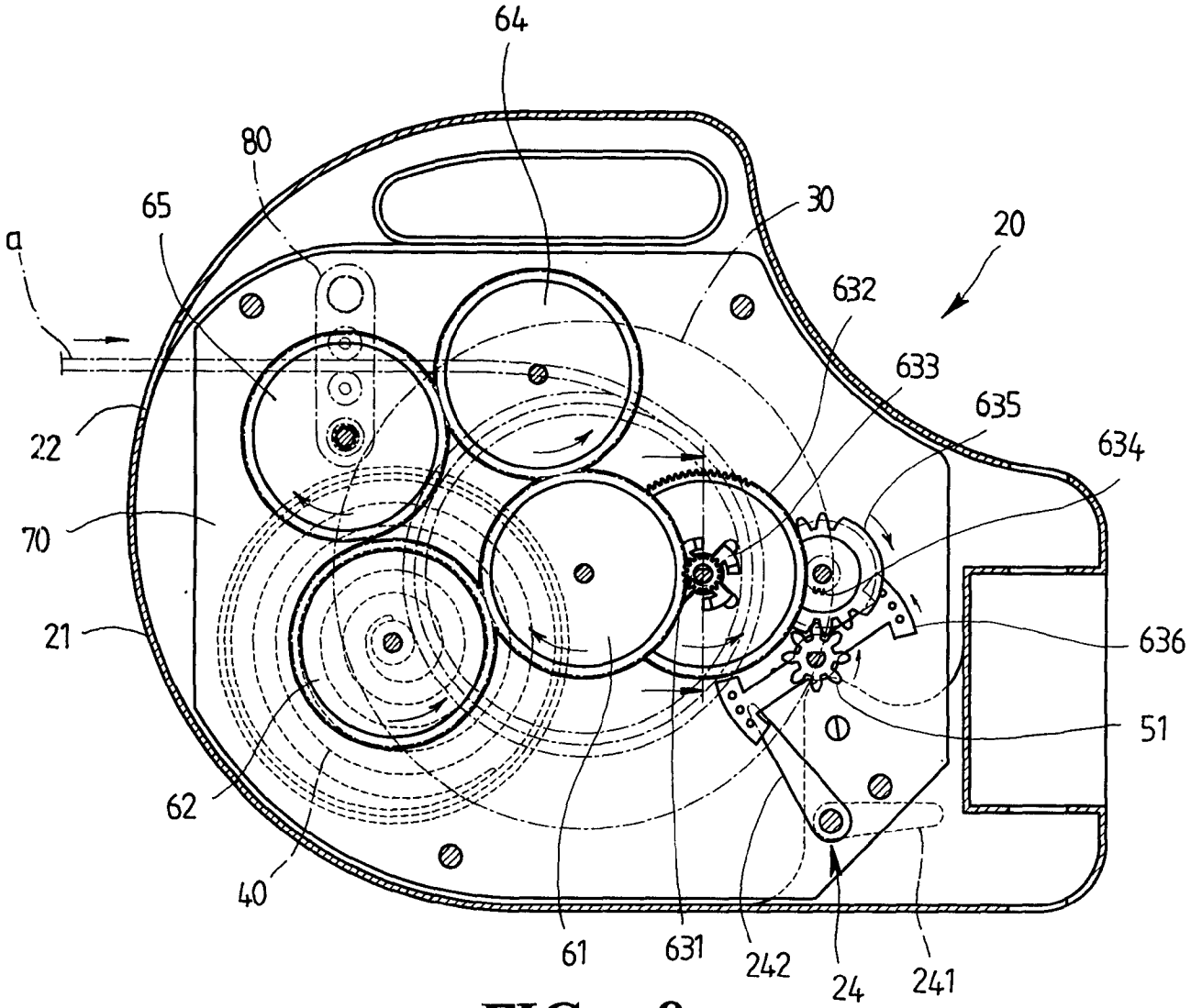
FIG. 8 shows that the locking gear is released from the pawl of the hose reel device of the present invention.

As shown in FIG. 8, when retrieving the hose "a", the lever 241 is pivoted and the pawl 242 is removed from the locking gear 51. The coil spring 40 pulls the hose "a" and the first gear 61 activates the resistance gear set 63, and the rotational direction of the clutch member 633 expands the tongues 6331 to engage the holes 6321 in the fourth gear 632, so that the friction between the gears of resistance gear set 63 reduces the speed of the retrieve of the hose "a". The flywheel 636 stores energy when the coil spring 40 is totally released and this energy effectively retrieves the last section of the hose "a".

Figure 9:
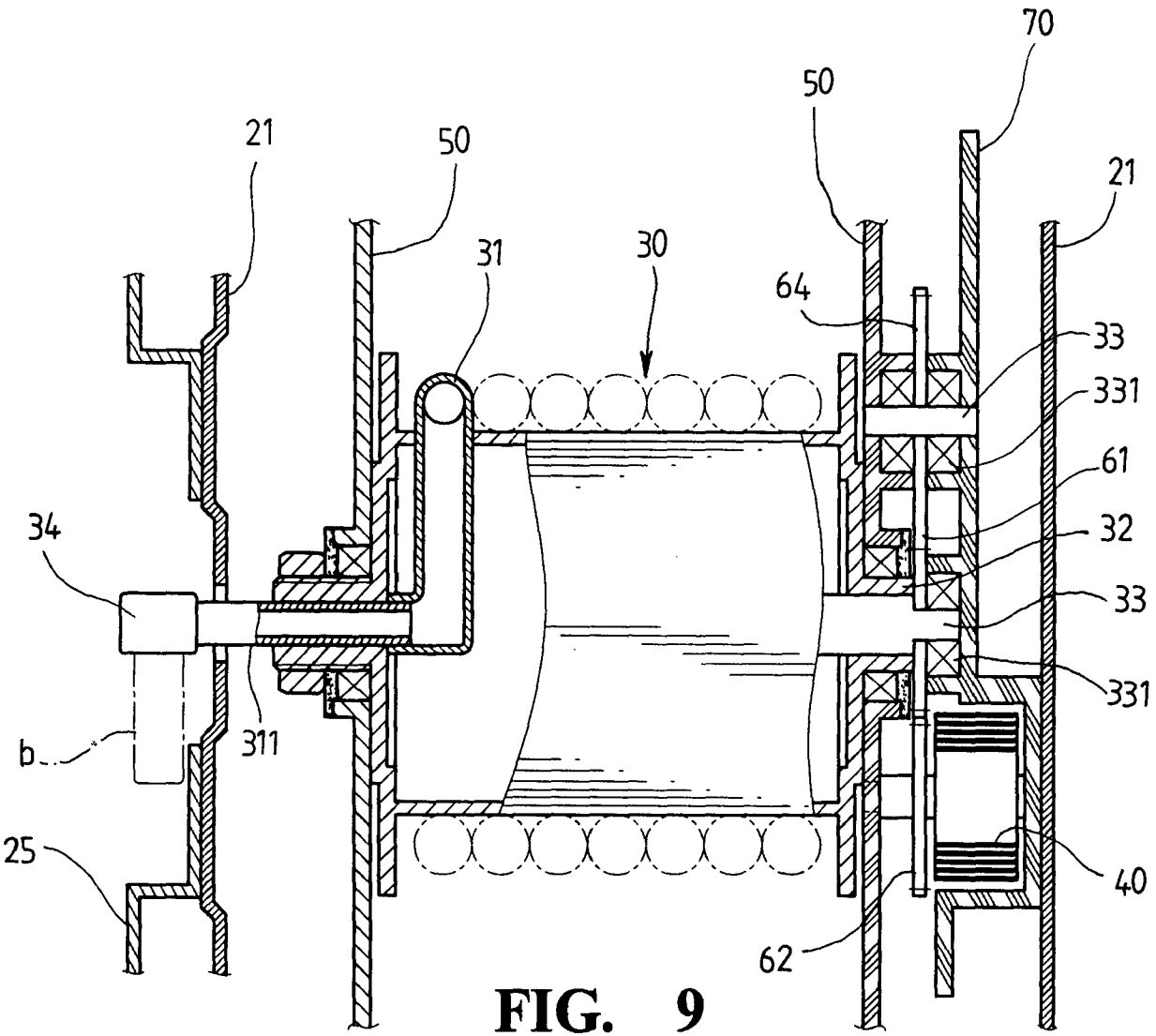
FIG. 9 shows a pneumatic pipe is connected to the extension tube of the mandrel.

As shown in FIG. 9, an extension tube 311 is connected to the mandrel 30 and extends out from the casing 20 and an adapter 34 is connected to the extension tube 311 so that a pneumatic hose "b" can be connected to the adapter 34. A plurality of extension plates 25 extend outward from the casing 20 so as to define a space to organize pneumatic hose "b".

Figure 10:
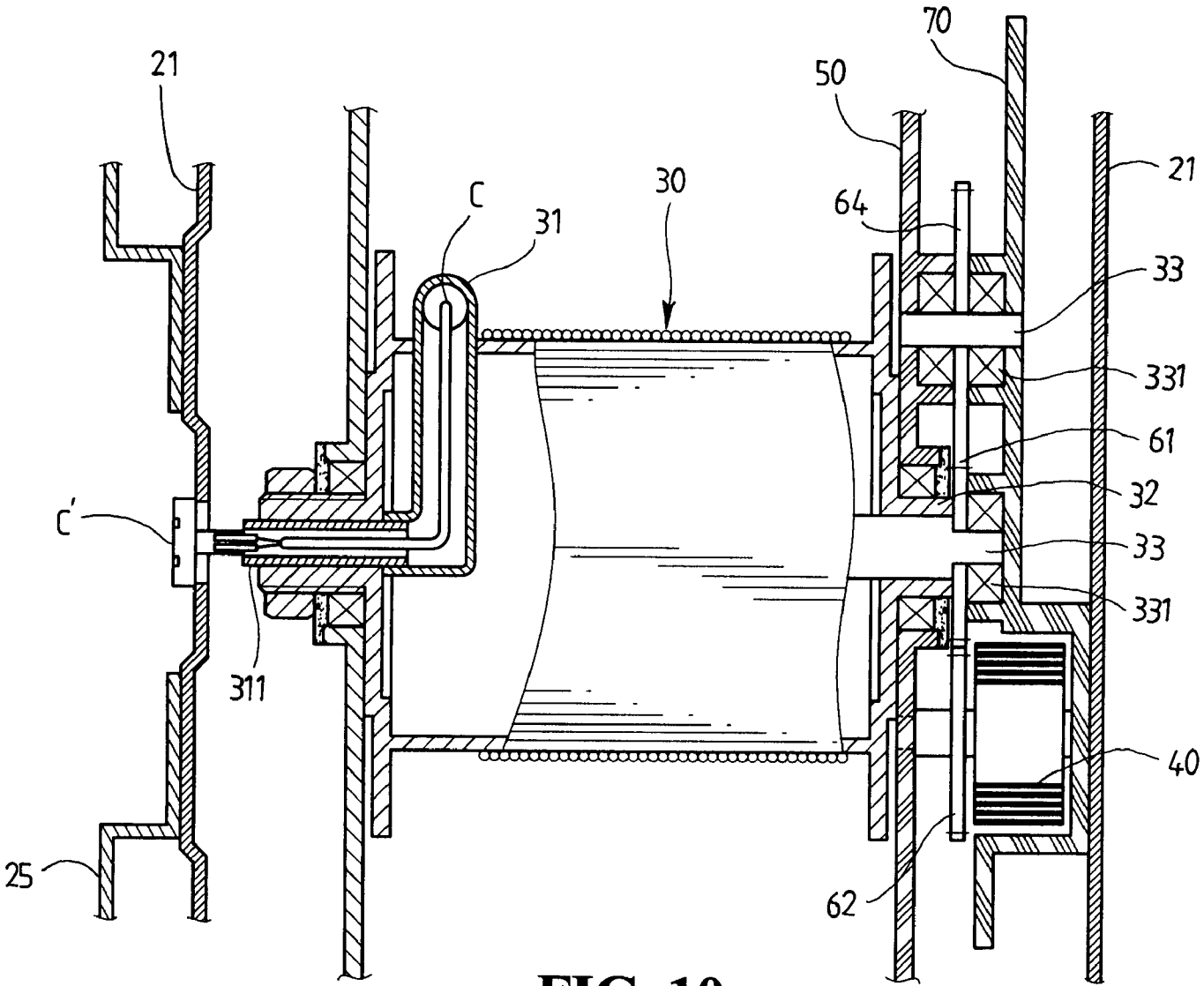
FIG. 10 shows an electric receptacle is connected to an end of the extension tube.

As shown in FIG. 10, an electric receptacle "c' "is connected to an end of the extension tube 311 so that the hose reel can also be used to receive electric wires "c".

Figure 11:
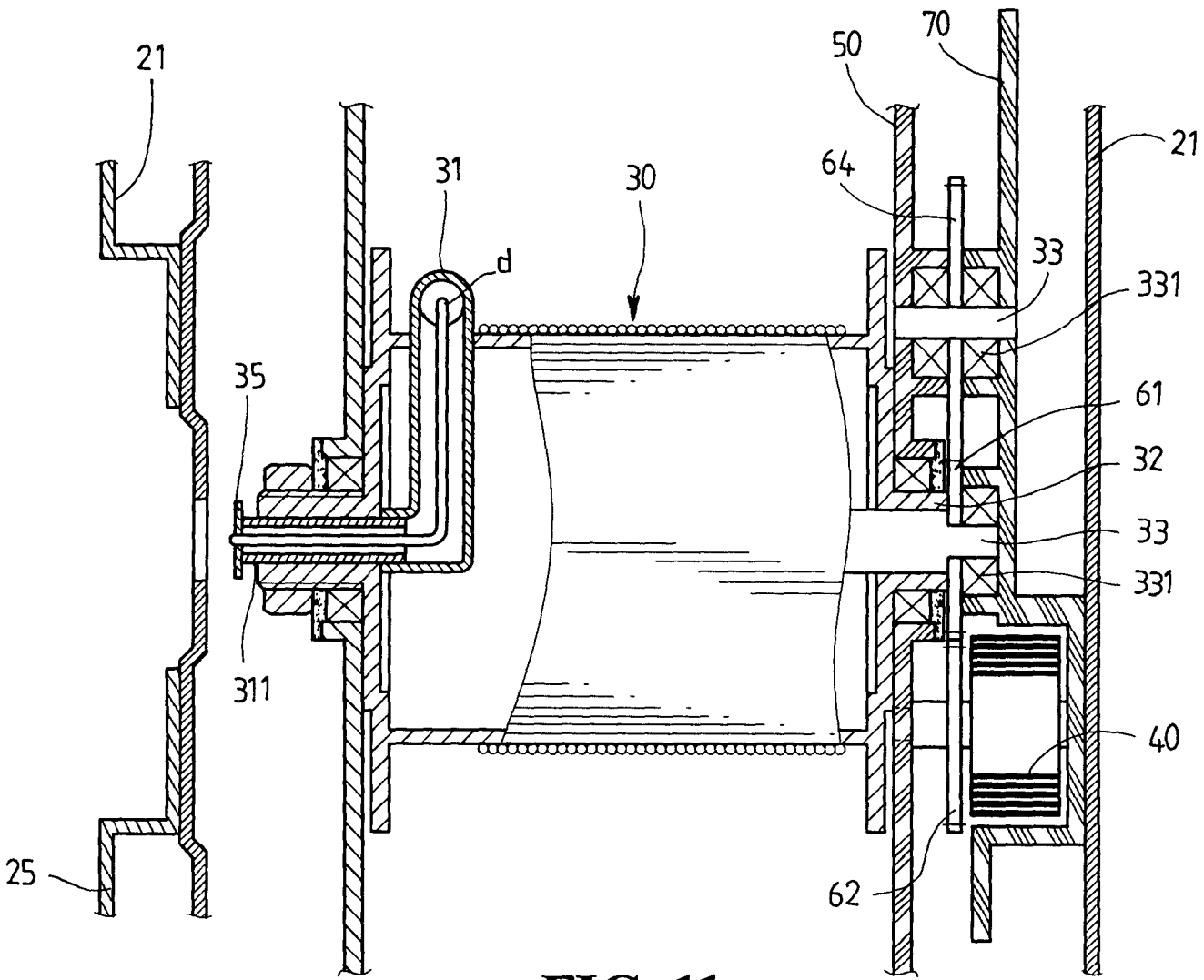
FIG. 11 shows a rope is wrapped on the mandrel of the hose reel device of the present invention.

FIG. 11 shows that if a rope "d" is wrapped on the mandrel 30, an end plate 35 is used to fixed an end of the rope "d" at the distal end of the extension tube 311.

While we have shown and described the embodiment in accordance with the present invention, it should be clear to those skilled in the art that further embodiments may be made without departing from the scope of the present invention.

What is claimed is:

1. A hose reel device comprising:

a casing having a box received therein and a mandrel located in the box, a hose wrapped on the mandrel;

a side plate connected to an end of the box and having a shaft extending from an inside of the side plate, a coil spring mounted to the shaft and having a first end fixed to the shaft and a second end of the coil spring fixed to the side plate;

a transmission gear set located between the box and the side plate and including a first gear co-axially connected to an axle of the mandrel, a second gear co-axially connected to the coil spring and engaged with the first gear, a resistance gear set being engaged with the first gear and including a clutch member which disengages the rotational movement of the first gear from the resistance gear set when pulling the hose, and connects the rotational movement of the first gear to the resistance gear set when retrieving the hose.

2. The device as claimed in claim 1, wherein a wall extends from the side plate and encloses a space for receiving the coil spring, a notch defined in the wall and the second end of the coil spring engaged with the notch.

3. The device as claimed in claim 1, wherein the resistance gear set includes a third gear which is engaged with the first gear and has less number of teeth than the first gear, a fourth gear co-axially connected to the third gear, a fifth gear engaged with the fourth gear and having less number of teeth than the fourth gear, a sixth gear co-axially connected to the fifth gear, a locking gear engaged with the sixth gear and a flywheel co-axially connected to the locking gear.

4. The device as claimed in claim 3, wherein the fourth gear includes a plurality of holes defined therethrough and a clutch member is located between the third gear and the fourth gear, the clutch member having a plurality of tongues which are pivotably connected to the clutch member, the tongues being expanded to engage with the holes in the fourth gear when the hose is retrieved.

5. The device as claimed in claim 3 further comprising a control member pivotably connected to the casing and includes a lever and a pawl which disengagably locks locking gear by operating the lever.

6. The device as claimed in claim 3 further comprising a transmission gear engaged with the first gear and a driving gear respectively, the driving gear driving a guidance piece which evenly wraps the hose onto the mandrel.

* * * * *